US010252313B2

(12) United States Patent
Sandrin et al.

(10) Patent No.: US 10,252,313 B2
(45) Date of Patent: Apr. 9, 2019

(54) MOVABLE HEAD FOR A STRETCHING MACHINE

(71) Applicant: Danieli & C. Officine Meccaniche S.P.A., Buttrio (IT)

(72) Inventors: Luca Sandrin, Terzo di Aquileia (IT); Magdalena Dropalla, Buttrio (IT); Alessio Cattarossi, Udine (IT); Daniel Polito, Udine (IT); Traian Maier, Udine (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 951 days.

(21) Appl. No.: 14/400,634

(22) PCT Filed: May 13, 2013

(86) PCT No.: PCT/IB2013/053869

§ 371 (c)(1),
(2) Date: Nov. 12, 2014

(87) PCT Pub. No.: WO2013/171650

PCT Pub. Date: Nov. 21, 2013

(65) Prior Publication Data

US 2015/0096345 A1 Apr. 9, 2015

(30) Foreign Application Priority Data

May 14, 2012 (IT) ..... MI2012A0833

(51) Int. Cl.
*B21D 25/04* (2006.01)
*B21D 1/00* (2006.01)

(52) U.S. Cl.
CPC ..... *B21D 25/04* (2013.01); *B21D 1/00* (2013.01)

(58) Field of Classification Search
CPC ..... B21D 11/02; B21D 3/12; B21D 25/04
(Continued)

(56) References Cited

U.S. PATENT DOCUMENTS 2,889,865 A * 6/1959 Lalli ..... B21D 25/04 24/134 R
2,908,316 A * 10/1959 Albers ..... B21D 3/12 72/302

(Continued)

FOREIGN PATENT DOCUMENTS

CN 101690960 4/2010
CN 102346113 2/2012

(Continued)

OTHER PUBLICATIONS

EPO Machine Translation of DE3633480 C1, Jul. 2018.*

*Primary Examiner* — Pradeep C Battula
(74) *Attorney, Agent, or Firm* — Stetina Brunda Garred & Brucker

(57) ABSTRACT

A movable head (1, 1*a*) for a stretching machine for sheets or plates has a front portion (2, 2*a*) including sheet segments (3, 3*a*) parallel to one another and shaped so as to define a clamping mouth (18) and a stretching plane (XY) orthogonal to the sheet segments (3, 3*a*), wherein the mouth (18) comprises clamping means to lock a sheet (P) or plate, so that a traction force (F) parallel to the stretching plane (XY) is applicable thereto, a rear portion (4, 4*a*) firmly connected to the front portion (2, 2*a*) so as to stiffen the front portion (2, 2*a*), and stiffening tie-rods (20), arranged parallel to the stretching plane (XY) for connecting the front portion and the rear portion (2, 4; 2*a*, 4*a*) to each other.

8 Claims, 5 Drawing Sheets

(58) Field of Classification Search
USPC ..... 72/302
See application file for complete search history.

(56) References Cited

U.S. PATENT DOCUMENTS

| | | | | | |
|---|---|---|---|---|---|
| 4,497,193 | A * | 2/1985 | Kutz | ..... | B21D 25/04 72/302 |
| 6,701,766 | B2 * | 3/2004 | Halleck | ..... | B21D 25/04 72/302 |
| 8,943,869 | B2 * | 2/2015 | Li | ..... | B21D 25/04 72/305 |
| 2007/0186612 | A1 * | 8/2007 | Stewart | ..... | B21D 25/02 72/302 |

FOREIGN PATENT DOCUMENTS

| | | | | | |
|---|---|---|---|---|---|
| DE | 1018075 | B | 3/1960 | | |
| DE | 3205701 | A1 | 10/1982 | | |
| DE | 3633480 | C1 * | 12/1987 | ..... | B21D 25/00 |
| DE | 102007009139 | B3 | 9/2008 | | |
| EP | 1243352 | A2 | 9/2009 | | |
| WO | WO 2011041984 | A1 * | 4/2011 | ..... | B21D 11/02 |

* cited by examiner

MOVABLE HEAD FOR A STRETCHING MACHINE

CROSS REFERENCE TO RELATED APPLICATIONS

The present application claims priority to PCT International Application No. PCT/IB2013/053869 filed on May 13, 2013, which application claims priority to Italian Patent Application No. MI2012A000833 filed May 14, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a movable head for a stretching machine for sheets or plates or the like.

BACKGROUND ART

Stretching machines are instruments usable for wholly or partly restoring the planarity of sheets, plates or other similar material having a mainly planar development, after it has been subjected to rolling or molding or heat treatment.

To this end, a stretching machine typically comprises a pair of movable heads usable for gripping two opposite edges of the same material to be stretched by applying two respective and opposite traction forces. Each movable head comprises a front portion and a rear portion, which can be assembled together. Such a two-portion configuration makes the movable head easier to be moved during the production, assembly and maintenance operations of the same, for example if it is necessary to arrange the packaging and shipping of the movable head.

The front portion is provided with a mouth and clamping means active in said mouth for gripping and retaining the edge of the material to be stretched so that a traction force applied to the movable head along a longitudinal direction thereof may be transmitted to the material to be stretched. The front portion mouth normally extends according to a transversal direction orthogonal to the longitudinal direction. The longitudinal and transversal directions form a stretching plane of the stretching machine along which the sheet or plate tends to arrange itself due to the application of the traction force. The front portion of the movable head normally consists of a plurality of sheet segments parallel to and spaced apart from one another, arranged perpendicularly to the stretching plane.

In such a clamping head, the front portion and the rear portion are connected to each other so as to form a single stiff element, particularly resistant to bending, i.e. to a deformation caused by stresses orthogonal to the stretching plane. In fact, one problem of movable heads for stretching machines consists of the gap, between the front portion and the rear portion, which forms when the apparatus is operating, i.e. when the traction force is applied to the material to be stretched. Such a force deforms the sheet segments, which lose contact with the rear portion of the movable head. The gap that is created between the sheet segments and the rear portion does not affect the application of the traction force but causes dangerous backlashes in case of breakage of the sheet or if the clamping is lost.

A solution to such a problem is provided in DE 102007009139, which describes a second rear portion firmly restrained to the first front portion so as to support the sheet segments and impart bending resistance to the structure. The second rear portion consists of a pair of half shells, opposite to the stretching plane, engaged in respective recesses arranged in each sheet segment and connected to each other by means of a plurality of tie-rods orthogonal to the stretching plane.

During the operation of a stretching machine of the type described in DE102007009139, the application of the traction force by the clamping means of the clamping head causes the at least partial loss of the contact between them and the half shells of the rear portion. In the practice, two taper gaps having the vertex facing the stretching plane are formed between the front and rear portions of the stretching machine, on opposite sides with respect to the stretching plane. In order to obviate such a drawback, thus preventing the loss of contact and continuity between the front and rear portions, and ensuring the required stiffness of the system under all the operating conditions, a pair of wedges are provided, which wedges are able to be respectively pushed, by means of two respective pneumatic cylinders, into the two taper gaps, thus remaining in contact with the two inclined surfaces thereof, i.e. in contact with both the front and rear portions of the stretching machine.

The required presence of such a pair of wedges is the main drawback of the above solution. In fact, installing the wedges and the pneumatic cylinders and managing them during the stretching operations make such a stretching machine apt to be improved from the point of view of the construction simplicity and of the operating convenience.

SUMMARY

The object of the present invention is to obviate the above-mentioned drawbacks related to the prior art, by providing a new stretching machine for sheets or plates or the like, in which the stiffness required by the operating conditions is provided by means of technical devices which are constructionally simpler and more practical and functionally more effective.

According to the invention, the above object is achieved by a stretching machine having the features set forth in independent claim 1.

In particular, the invention refers to a movable head for a stretching machine for sheets or plates or the like, said movable head comprising:

- a first front portion including a plurality of sheet segments parallel to one another and shaped so as to define a clamping mouth provided with an opening facing a front surface of said first portion, said opening being defined by two reciprocally opposite lips so as to define a stretching plane orthogonal to said sheet segments and equally spaced apart from said lips, said mouth comprising clamping means to lock a sheet or plate or the like passing through said opening of said mouth, so that a traction force parallel to said stretching plane is applicable to said sheet or plate or the like,
- a second rear portion firmly connected to said first front portion so as to stiffen said first portion, characterized in that said first and second portions are connected to each other by means of a plurality of stiffening tie-rods, arranged parallel to said stretching plane.

The arrangement of the stiffening tie-rods, orthogonal with respect to an interface surface between the first and the second portions of the stretching machine, allows the condition of perfect contact to be maintained at such an interface surface, under all the operating conditions. Therefore, no other means are required for compensating the loss of stiffness during the operation of the stretching machine, as in the stretching machine described in DE 102007009139.

Other advantages of the present invention are achieved by means of a driving device according to the dependent claims, as better described in the following description. In particular, the fact that a first and a second block are provided in the first front portion of the stretching machine, to which blocks the sheet segments are firmly restrained by welding, allows the first front portion to be made as an individually movable unit. Therefore, such a unit can then be connected in a simple and efficient manner to the second rear portion by applying the plurality of stiffening tie-rods.

Alternatively, according to another possible embodiment variant of the present invention, the sheets segments can be directly connected, by means of the tie-rods, to the second rear portion. This allows the sheet segments to be individually moved during the assembly or for transportation, thus allowing the implementation of larger movable heads as compared to the variant with welded sheet segments, while avoiding the welding operations.

BRIEF DESCRIPTION OF THE DRAWINGS

Further features and advantages of the present invention will become more evident from the following detailed description of a preferred but non exclusive embodiment thereof, made by way of a non-limiting example with reference to the accompanying drawings, in which.

The same reference numerals in the figures denote the same elements or components.

DETAILED DESCRIPTION OF THE INVENTION

Figure 9:
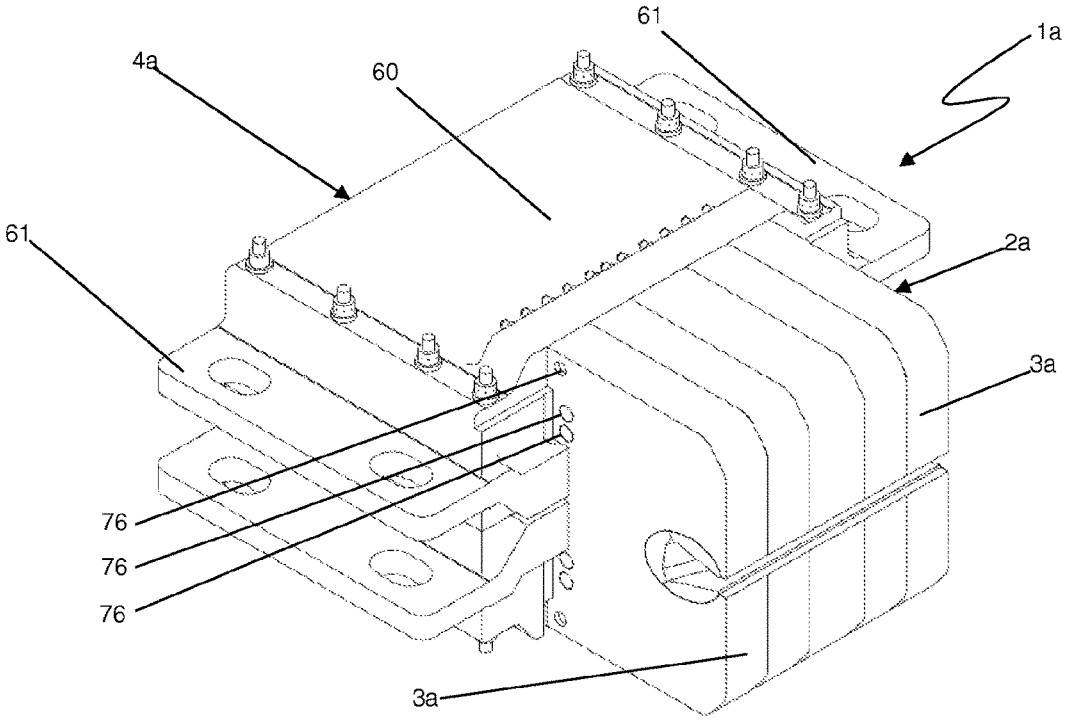
FIG. 9 shows an axonometric view of an embodiment variant of the movable head in FIG. 1.
Figure 10:
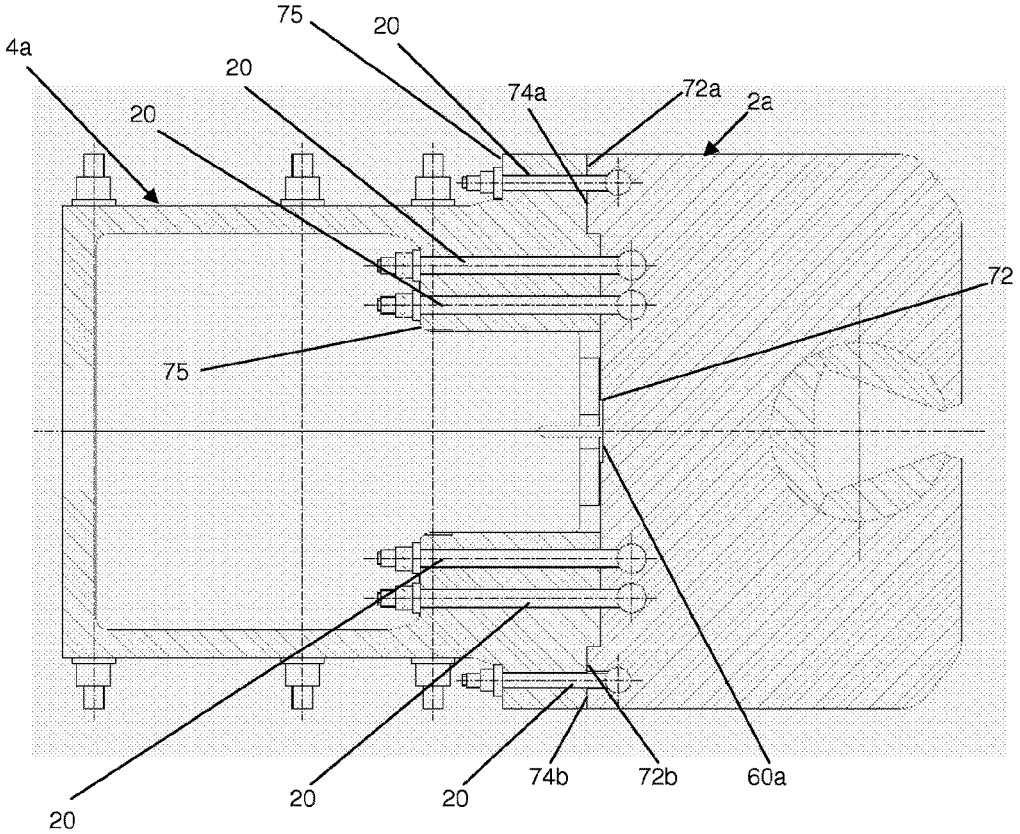
FIG. 10 shows a side sectional view, corresponding to the view in FIG. 2, of the movable head variant in FIG. 9.

With reference to the accompanying drawings, a movable head applicable to a stretching machine (not shown as a whole) for sheets or plates or other similar products is indicated as a whole with reference numeral 1 (FIGS. 1-8*e*). An embodiment variant of the movable head according to the present invention is indicated as a whole with reference numeral 1*a* (FIGS. 9 and 10).

A stretching machine typically comprises a pair of movable heads arranged so as to grip two opposite edges of the same material to be stretched, e.g. a sheet P, by applying two respective and opposite traction forces.

With initial reference to the accompanying FIGS. 1-8*e*, the movable head 1 comprises a first front portion 2 and a second rear portion 4, firmly restrained to each other.

The first portion 2 includes a plurality of sheet segments 3 identical in shape, arranged so as to be parallel to one another and spaced apart along a longitudinal direction, orthogonal to the sheet segments 3 themselves.

Each sheet segment 3 comprises two main surfaces 6*a,b* reciprocally opposite and a lateral edge surface 7 extended between the main surfaces 6*a,b* along the thickness of the sheet segment 3. The edge surface 7 comprises a front side 11 and an opposite rear side 12, parallel to the front side 11. The edge surface 7 further comprises two sides 13*a,b*, respectively upper and lower sides, parallel to each other and orthogonal to the front and rear sides 11, 12. Two chamfers 14*a,b* are provided between the front side 11 and the two sides 13*a,b*, respectively. Two shoulders 12*a,b*—upper and lower shoulders—are provided on the rear side 12, adjacent to the two upper and lower sides 13*a,b*, respectively. A central stretch 12*c* of the rear side 12 is therefore defined between shoulders 12*a,b*, which stretch projects with respect to shoulders 12*a,b* and is connected thereto by means of two respective upper and lower sides 17*a,b*, respectively.

Close to the front side 11, each sheet segment 3 comprises a through hole 15 having an axis orthogonal to the main surfaces 6*a,b* of the sheet segment 3 and a connecting passageway 16 between the hole 15 and the front side 11.

All the sheet segments 3 are placed side by side so that the respective holes 15, aligned along a common transversal axis Y, form a clamping mouth 18 provided with an opening 10, consisting of the set of the respective passageways 16 of the sheet segments 3. Opening 10 faces a front surface 19 consisting of the envelope of the front sides 11 of the sheet segments 3. Opening 10 is defined by two lips 10*a,b* opposite to each other so as to define a longitudinal axis X, orthogonal to the transversal axis Y and equally spaced apart from lips 10*a,b* of opening 10.

The longitudinal X and transversal Y axes form a stretching plane XY orthogonal to the sheet segments 3, which are shaped so as to be symmetrical to the stretching plane XY, as described above.

Clamping means 31*a,b* are provided inside mouth 18, comprising a pair of wedges 31*a*, opposite to the stretching plane XY, and movable towards the stretching plane XY for locking an edge of sheet P passing through the opening 10 in mouth 18, so that a traction force F lying on the stretching plane XY and parallel to axis X can be applied to sheet P. Wedges 31*a* are movable along two respective surfaces 31, inclined with respect to the stretching plane XY. On the side facing the stretching plane XY, each wedge 31*a* carries a respective clamping plate 31*b*, apt to abut against the edge of sheet P so as to lock it by friction into mouth 18. At the end of the stretching operations, the clamping means are moved away from the stretching plane XY, so as to allow sheet P to be released through opening 10. The first portion 2 of the movable head 1 further comprises a first and a second block 21, 22, parallelepiped in shape, opposite to each other with respect to the stretching plane XY and orthogonally extended with respect to the sheet segments 3. Each block 21, 22 comprises a plurality of through holes 26 (in the examples of the accompanying FIGS. 1-8*e*, three holes for each block 21, 22), arranged parallel to the transversal axis Y. Each sheet segment 3 is next to blocks 21, 22 so that the upper shoulder 12*a* and the upper side 17*a* are next to the first block 21 while the lower shoulder 12*b* and the lower side 17*b* are next to the second block 22. The size of blocks 21, 22 in a side view orthogonal to the sheet segments 3 (FIGS. 2 and 3) is equal to the length of shoulders 12*a,b* and of sides 17*a,b,* so that both blocks are aligned with the central stretch 12*c* of the rear side and aligned with the upper and lower sides 13*a,b* of each sheet segment 3, respectively. The sheet segments 3 are firmly restrained to the first and second blocks 21, 22, for example by welding along each one of shoulders 12*a,b* and sides 17*a,b.*

In other embodiment variants of the present invention (FIGS. 6, 7 and 8*a-e*), two shoulders having the same width are provided on each one of blocks 21, 22, respectively, which shoulders identify two respective portions farther from the stretching plane XY, 21*a*, 22*a,* facing the second portion 4. Two sides 21*b*, 22*b,* parallel to the stretching plane XY are defined between the respective portions of blocks 21, 22 closer to the stretching plane XY and shoulders 21*a,* 22*a,* respectively.

The second portion 4 of the movable head 1 consists of a central body 40 and of two tabs 41. The central body 40 has an overall size almost equal to that of a parallelepiped with front surface 40*a* abutted against the central stretch 12*c* of the rear side 12 and against the blocks 21, 22 of the front portion 2. Each tab 41 supports a respective hollow cylinder 42 provided with a respective through hole 43 with axis parallel to the longitudinal axis X. Through holes 43 accommodate two respective cylinders, for example two hydraulic cylinders (not shown), which move the movable head 1 for transmitting the traction force F to sheet P.

In the embodiment variants in FIGS. 6, 7 and 8*a-e*, the central body 40 comprises two projecting stretches 51*a,* 52*a,* apt to abut in coupling (FIG. 7) against the two shoulders 21*a,* 22*a,* respectively. The projecting stretches 51*a,* 52*a* have a shorter length than the respective shoulders 21*a,* 22*a,* so that two respective cavities 53, 54 are defined between the sides 21*b,* 22*b* of shoulders 21*a,* 22*a* and the two respective sides 51*b,* 52*b* of the projecting stretches 51*a,* 52*a* so as to facilitate, in the assembly step, the coupling between the front and rear portions 2, 4 of the movable head 1. The clearance at cavities 53, 54 is eliminated by using wedges accommodated therein. In a first variant (FIG. 8*b*), two taper keys 61, 62 are provided in each cavity 53, 54. The taper keys are arranged so that the respective oblique sides are facing towards each other. In a second variant (FIG. 8*c*), sides 51*b,* 52*b* are inclined with respect to the stretching plane XY, so that cavities 53, 54 have a triangular section. In such a second variant, a single taper key 63 is accommodated in each cavity 53, 54. In a third variant (FIG. 8*d*), two pairs of taper keys 64*a,b* and 65*a,b* placed side by side are provided along sides 21*b,* 22*b* and 51*b,* 52*b*. In each pair 64*a,b* and 65*a,b*, the two keys are facing towards each other, as in the first variant in FIG. 8*b*. In a fourth variant (FIG. 8*e*), sides 51*b,* 52*b* have a triangular profile and are apt to abut with the respective vertexes against sides 21*b,* 22*b,* so as to divide each cavity 53, 54 into two respective portions with triangular section, in which two taper keys 66, 67 are accommodated, respectively.

With reference to the accompanying FIGS. 9 and 10, the movable head 1*a* differs from the above-described movable head 1 in that it does not comprise welded sheet segments but bolted sheet segments, thus allowing the stretching machine to have larger dimensions or to prevent welds from being carried out under critical circumstances, e.g. if the thickness or the material of the sheet segments is difficult to be welded. This is obtainable by means of a first front portion 2*a* comprising a plurality of sheet segments 3*a,* but free from blocks 21, 22. The sheet segments 3*a* are directly couplable to a second rear portion 4*a* of the movable head 1*a*. Accordingly, in the production steps prior to the assembly of the first front portion 2*a* with the second rear portion 4*a,* the sheet segments 3*a* may be individually handled. This allows the sheet segments 3*a* to be made with larger dimensions than the sheet segments 3 of the movable head 1 and accordingly, as a whole, it is possible to make the movable head 1*a* with larger dimensions than the movable head 1, in which the sheet segments 2 need to be first welded to blocks 21, 22. Moreover, the absence of welds allows the sheet segments 3*a* to be made of alloyed steel (such as EN10250-3 30CrNiMo8 or EN10025-6 S690Q) compared to that of the sheet segments 3. At the front side 11, the sheet segments 3, 3*a* are morphologically identical, all comprising a respective hole 15, so as to form the mouth 18 when a plurality of sheet segments is aligned to form the front portion 2, 2*a.* Each sheet segment 3*a* further comprises a plurality of through holes 76 (in the example of the accompanying FIGS. 9 and 10, six holes for each sheet segment, symmetrically distributed with respect to the longitudinal axis X), arranged parallel to the transversal axis Y. The second portion 4*a* of the movable head 1*a* consists of a central body 60 and of two side portions 61, each comprising a pair of tabs 61*a,b*. The central body 60 is internally hollow and has an overall size almost equal to a parallelepiped. The central body 60 is provided with a front surface 60*a* abutting against a rear side 72 of each sheet segment 3*a*. The front surface 60*a,* in the two farthest portions from the stretching plane XY, is provided with two shoulders 74*a,b,* symmetrical with respect to the stretching plane XY. Shoulders 74*a,b* are respectively apt to abut in coupling (FIG. 10) against two projecting stretches 72*a,b* of the rear side 72 of each sheet segment 3*a*. According to a different embodiment variant (not shown), shoulders 74*a,b* are obtained on the sheet segments 3*a* while the two projecting stretches 72*a,b* are placed on the front surface 60*a*. Each pair of tabs 61*a,b* is apt to be coupled to a supporting structure (not shown and not described as it is not an object of the present invention).

In all the embodiment variants, the second rear portion 4, 4*a* is firmly connected to the first front portion 2, 2*a* by means of a plurality of stiffening tie-rods 20, arranged parallel to the stretching plane XY. Each tie-rod 20 connects the first portion 2, 2*a* to the second portion 4, 4*a,* respectively.

With reference to the accompanying FIGS. 1-8*e,* each tie-rod 20 extends between a first end 20*a* firmly restrained to the first or second block 21, 22, by means of a respective locking nut accommodated in one of the through holes 26, and a second end 20*b* projecting with respect to a respective abutment surface 45, orthogonal to the stretching plane XY, provided in the second rear portion 4. A nut 25 is provided at the second end 20*b,* which nut abuts against the respective surface 45, for imparting the required stretching status to the respective tie-rod 20. According to other embodiment variants (not shown), each end 20*a* is firmly restrained to the first or second block 21, 22 in a different manner, e.g. by using a tie-rod consisting of a biting screw with its end 20*a* screwed in a respective hole provided in the first or second block 21, 22.

With reference to the accompanying FIGS. 9, 10, each tie-rod 20 extends between a first end 20*a* firmly restrained to one of the sheet segments 3*a* by means of a respective locking nut accommodated in one of the through holes 76, and a second end 20*b* projecting with respect to a respective abutment surface 75, orthogonal to the stretching plane XY, provided in the second rear portion 4*a*.

In general, in all the embodiment variants, for the purposes of the present invention, the overall load applied to tie-rods 20, i.e. the sum of the loads applied to every single tie-rod, must be greater than the traction force F applied to sheet P.

In the different embodiment variants of the present invention, the number of tie-rods 20 depends on the dimensions of the movable head 1 and in particular on the front interface surface 40*a* between the front and rear portions 2, 4, so as to ensure an even stretching status in all the sheet segments 3.

In all the examples of the accompanying FIGS. 1-10, the tie-rods are arranged according to rows orthogonal to the stretching plane XY.

In the embodiment variants in FIGS. 1-8*e*, eight rows of six tie-rods 20 each are provided, for a total of 48 tie-rods, i.e. 24 active tie-rods on each one of blocks 21, 22. In the embodiment variant of the accompanying FIGS. 9 and 10, a row of six tie-rods 20 is provided for each sheet segment 3*a*.

Figure 1:
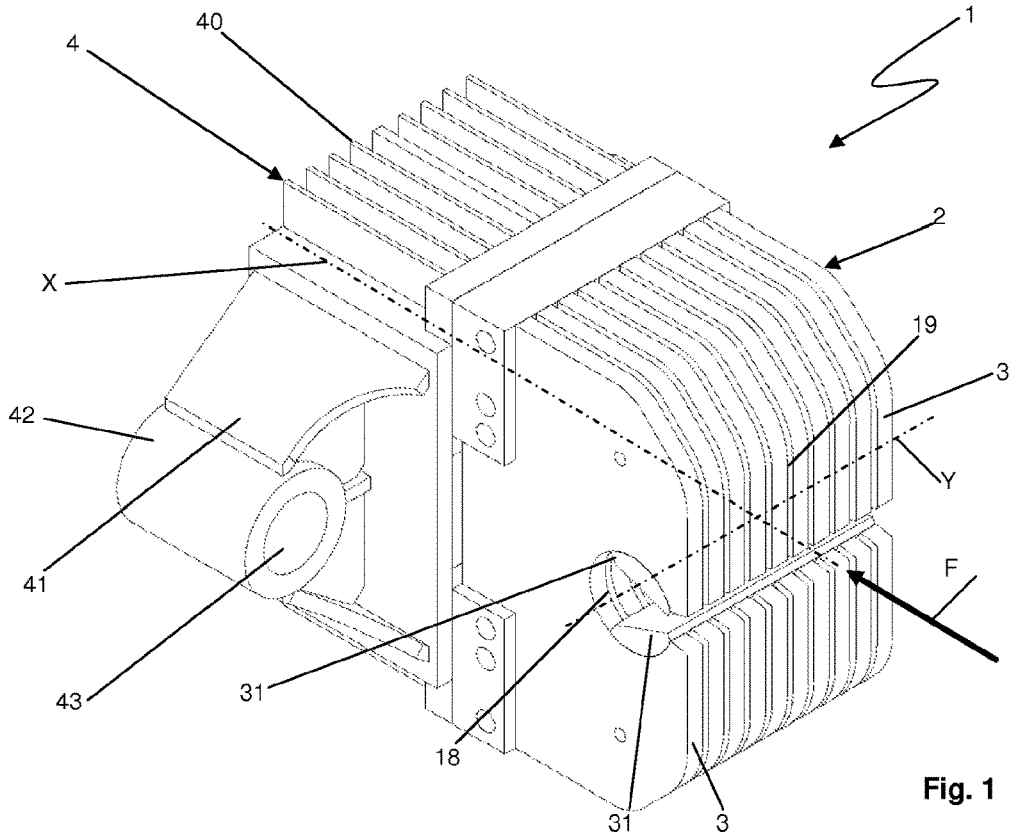
FIG. 1 shows an axonometric view of a movable head of a stretching machine according to the present invention.
Figure 2:
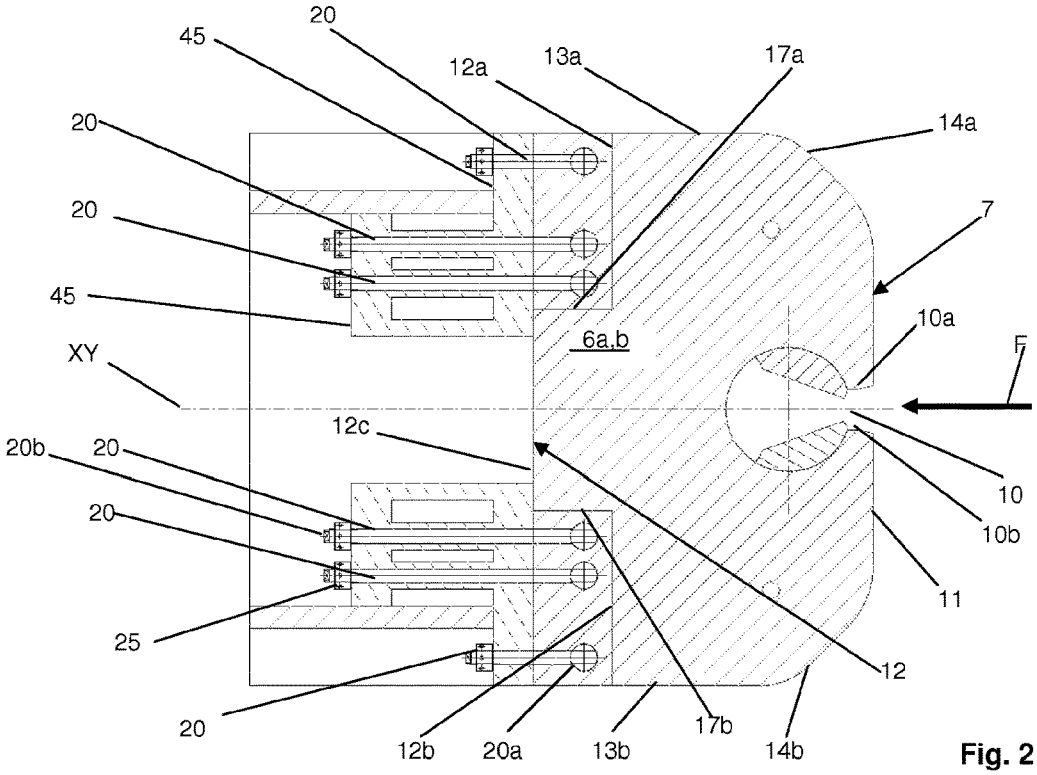
FIG. 2 shows a side sectional view of the movable head in FIG. 1.
Figure 3:
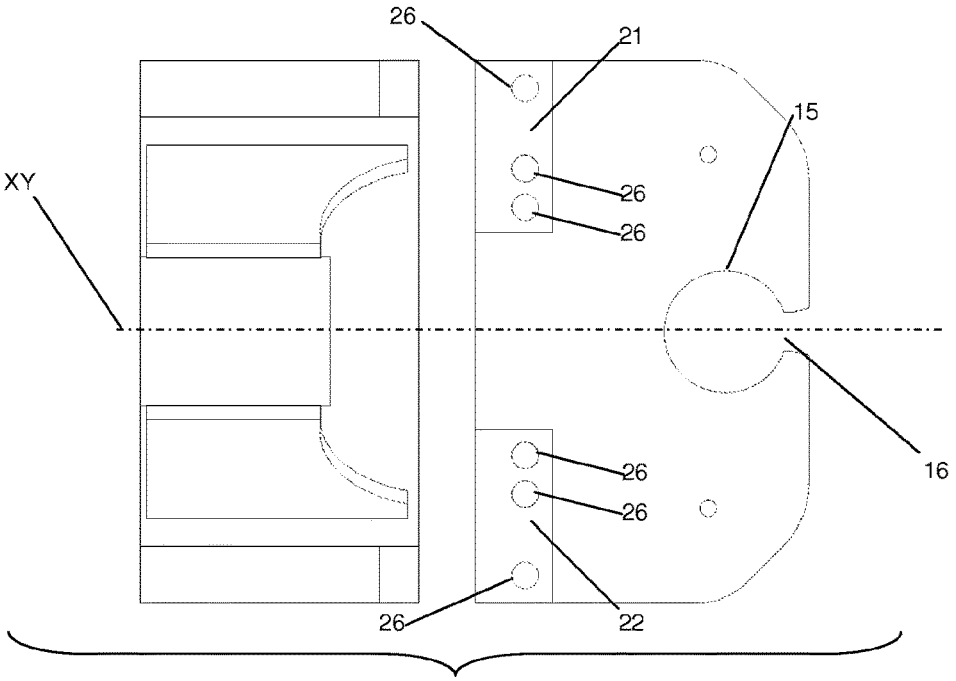
FIG. 3 shows a side view of two components of the movable head in FIG. 1.
Figure 4:
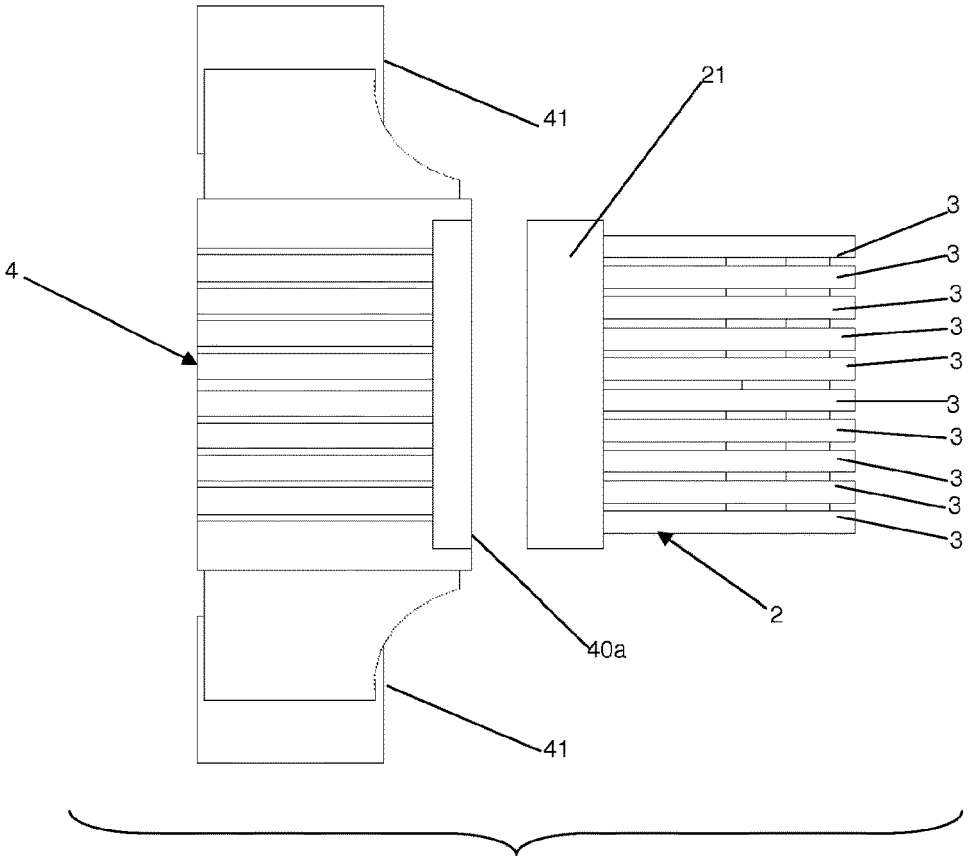
FIG. 4 shows a top plan view of the components in FIG. 3.
Figure 5:
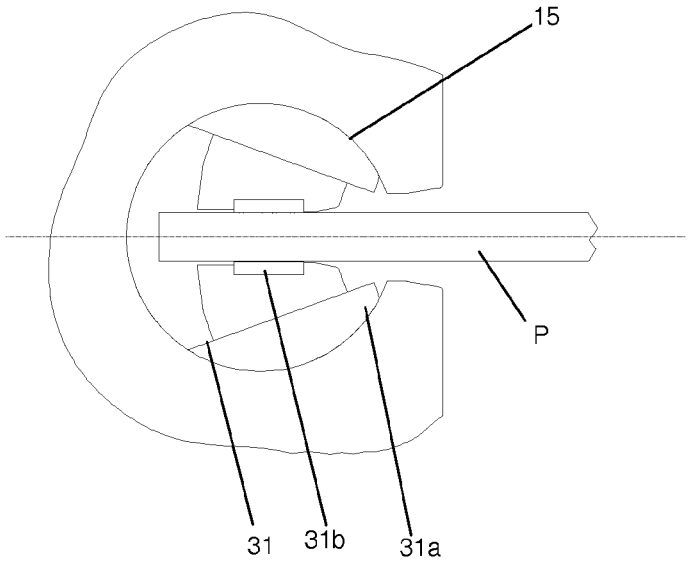
FIG. 5 shows a detailed side view of the movable head in FIG. 1 in an operating configuration thereof.
Figure 6:
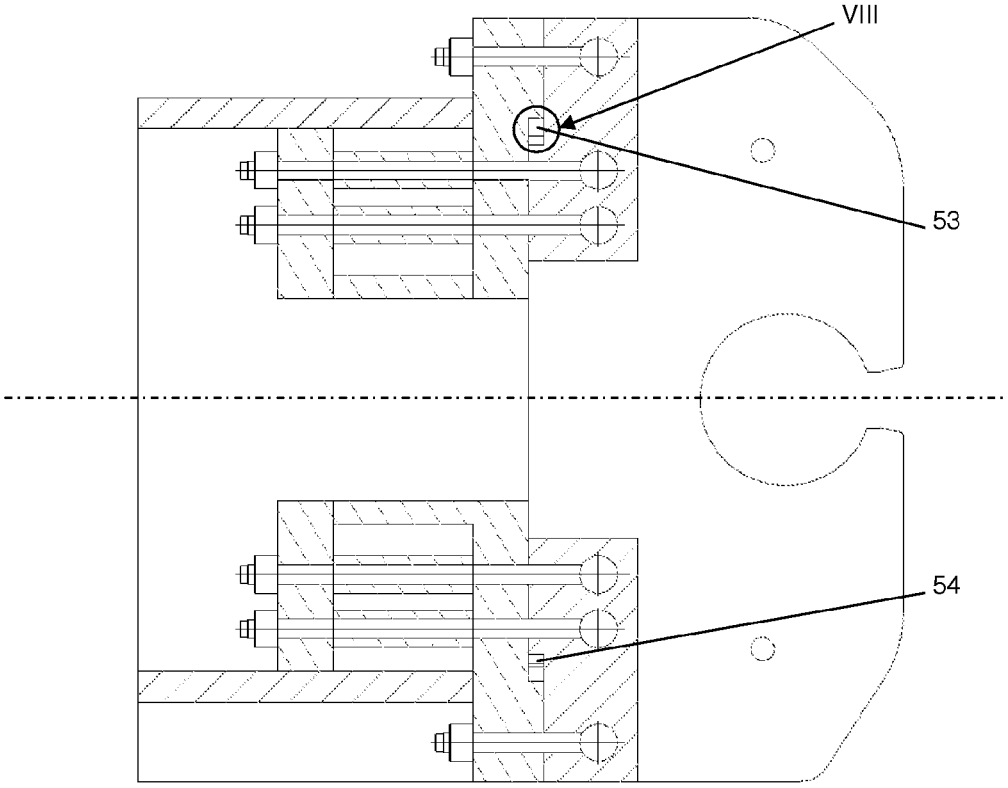
FIG. 6 shows a side sectional view, corresponding to that in FIG. 2, of a possible embodiment variant of the present invention.
Figure 7:
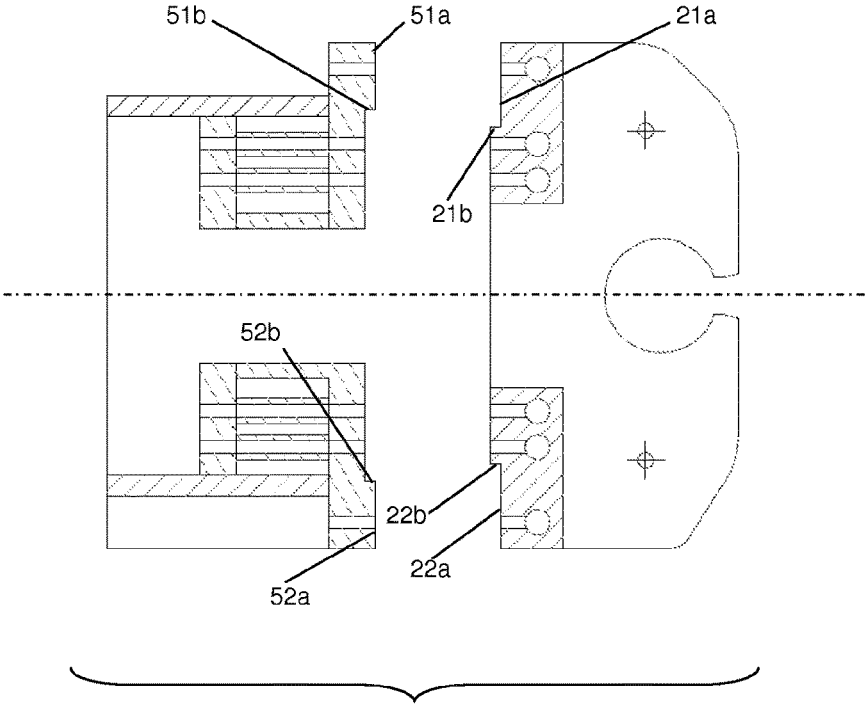
FIG. 7 shows a side sectional view, corresponding to that in FIG. 2, of the embodiment variant in FIG. 6.
Figure 8A:
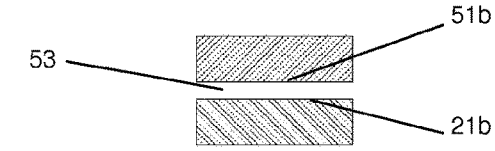
FIGS. 8*a-b* show two respective enlarged views of detail VIII in FIG. 6, in two respective operating configurations.
Figure 8B:
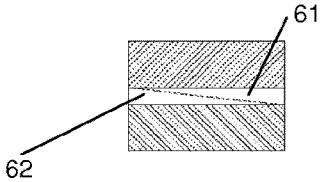
Figure 8C:
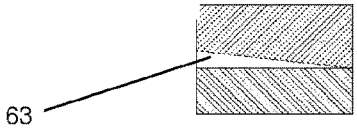
FIGS. 8*c-e* show three views, corresponding to that in FIG. 8*b*, of three respective embodiment variants of the present invention.
Figure 8D:
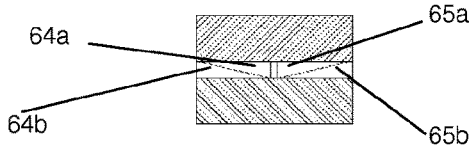
Figure 8E:
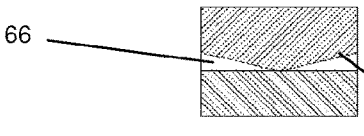

In all the embodiment variants of the accompanying FIGS. 1-10, in each row the tie-rods are symmetrically distributed with respect to the stretching plane XY (in the example of the accompanying figures: six tie-rods 20 for each row, three tie-rods 20 above the stretching plane XY and three tie-rods 20 beneath plane XY). In some variants of the present invention, as shown in FIG. 2 and FIG. 10, in each row the tie-rods 20 which are farther from the stretching plane XY are shorter than the four tie-rods 20 which are closer to the stretching plane XY. Such a choice is determined by the fact that blocks 21 and 22, in their respective parts farther from the stretching plane XY, are compressed, and accordingly the corresponding part of the rear portion 4 is not required to impart a particular stiffness, i.e. the respective abutment surface 45 may be closer to the front surface 40*a*.

According to another embodiment variant (not shown), tie-rods 20 have all the same length. In general, the length of tie-rods 20 may be selected, in the different embodiment variants of the present invention, so as to ensure the stiffness required for the correct operation of the movable head 1.

The described technical solutions allow the intended task and objects to be fully achieved with reference to the mentioned prior art, thus achieving a plurality of further advantages.

Among these, the movable head 1 allows a stretching machine to be implemented, consisting of only two main portions 2, 4, individually movable, constrained to each other in a permanently stiff manner. Alternatively, according to the present invention, the movable head 1*a* allows a stretching machine to be implemented, in which each sheet segment 3*a* of the front portion 2*a* is directly constrainable to the rear portion 4*a*. Therefore, the latter solution is characterized by a larger number of elements to be moved for obtaining the final assembly, but this allows larger elements to be managed, thus obtaining a larger stretching machine as compared to the solution with welded sheet segments or to a stretching machine with sheet segments made of alloyed steel which are difficult to be welded.

The invention claimed is:

1. A movable head for a stretching machine for sheets or plates, said movable head comprising:

a front portion including a plurality of sheet segments parallel to one another and shaped so as to define a clamping mouth provided with an opening facing a front surface of said front portion, said opening being defined by two reciprocally opposite lips so as to define a stretching plane orthogonal to said sheet segments and equally spaced apart from said lips, said clamping mouth comprising clamping means to lock said sheet or plate passing through said opening of said clamping mouth, so that a traction force parallel to said stretching plane is applicable to said sheet or plate, a rear portion firmly connected to said front portion so as to stiffen said front portion, wherein the front portion has an abutment surface which is in abutment with an abutment surface of the rear portion; and wherein said front portion and said rear portion are rigidly connected to each other by means of a plurality of stiffening tie-rods, arranged parallel to said stretching plane and parallel to said traction force when the traction force is applied, and orthogonal with respect to the abutment surface of the front portion and to the abutment surface of the rear portion, so that the plurality of stiffening tie-rods prevents relative movements between the front portion and the rear portion.

2. A movable head according to claim 1, wherein said front portion comprises a first block and a second block opposed to each other with respect to the stretching plane and orthogonally extended with respect to said sheet segments, each sheet segment of said plurality of sheet segments being firmly restrained to said first block and second block.

3. A movable head according to claim 2, wherein each sheet segment of said plurality of sheet segments is welded to said first block and second block.

4. A movable head according to claim 2, wherein each stiffening tie-rod of said plurality of stiffening tie-rods extends between said rear portion and one of said first block and second block.

5. A movable head according to claim 2, wherein each of said first block and second block comprises, respectively, a shoulder butted up against an abutment provided on said rear portion.

6. A movable head according to claim 5, wherein, between each of said first block and second block and said rear portion, said movable head comprises at least one cavity in which at least one taper key is housed.

7. A movable head according to claim 1, wherein each stiffening tie-rod of said plurality of stiffening tie-rods extends between said rear portion and at least one of said sheet segments.

8. A stretching machine comprising a movable head according to claim 1.

* * * * *